US009506622B2

(12) United States Patent
Marinus et al.

(10) Patent No.: US 9,506,622 B2
(45) Date of Patent: Nov. 29, 2016

(54) ILLUMINATION DEVICE WITH CARRIER AND ENVELOPE

(75) Inventors: Antonius Adrianus Maria Marinus, Eindhoven (NL); Vincent Stefan David Stefan David Gielen, Eindhoven (NL); Peter Johannes Martinus Bukkems, Deurne (NL)

(73) Assignee: KONINKLIJKE PHILIPS ELECTRONICS N.V., Eindhoven (NL)

( * ) Notice: Subject to any disclaimer, the term of this patent is extended or adjusted under 35 U.S.C. 154(b) by 117 days.

(21) Appl. No.: 14/232,624

(22) PCT Filed: Jul. 9, 2012

(86) PCT No.: PCT/IB2012/053493

§ 371 (c)(1),
(2), (4) Date: Jan. 14, 2014

(87) PCT Pub. No.: WO2013/011408

PCT Pub. Date: Jan. 24, 2013

(65) Prior Publication Data

US 2014/0153261 A1 Jun. 5, 2014

Related U.S. Application Data

(60) Provisional application No. 61/508,111, filed on Jul. 15, 2011.

(51) Int. Cl.

| | |
|---|---|
| ***F21V 29/00*** | (2015.01) |
| ***F21V 3/00*** | (2015.01) |
| ***F21K 99/00*** | (2016.01) |
| ***F21V 29/506*** | (2015.01) |
| *F21Y 101/02* | (2006.01) |
| *F21V 29/85* | (2015.01) |

(52) U.S. Cl.

CPC ..... *F21V 3/005* (2013.01); *F21K 9/135* (2013.01); *F21V 29/506* (2015.01); *F21K 9/52* (2013.01); *F21V 29/86* (2015.01); *F21Y 2101/02* (2013.01)

(58) Field of Classification Search

CPC ..... F21K 9/00; F21K 9/10; F21K 9/13; F21K 9/135; F21K 9/1355; F21K 2099/005; H05K 5/0213

USPC ..... 362/311.1, 294

See application file for complete search history.

(56) References Cited

U.S. PATENT DOCUMENTS

2006/0098440 A1 5/2006 Allen
2006/0227558 A1 10/2006 Osawa et al.

(Continued)

FOREIGN PATENT DOCUMENTS

CN 2651587 Y 10/2004
CN 201344404 Y 1/2009

(Continued)

*Primary Examiner* — Ali Alavi

(57) ABSTRACT

An illumination device comprising a light source (110). The illumination device comprises a thermally conducting carrier (130) arranged to support the light source. Furthermore, the illumination device comprises an envelope (120), wherein the carrier and the envelope together form a single compartment (140) at least partially enclosing the light source. The carrier is arranged to transfer heat (160) away from the light source to the envelope, and the envelope is arranged to dissipate heat (170) away from the illumination device. The carrier and the envelope of the illumination device may further form a single integrated part.

19 Claims, 4 Drawing Sheets

(56) References Cited

U.S. PATENT DOCUMENTS

| | | | | |
|---|---|---|---|---|
| 2008/0310158 | A1 | 12/2008 | Harbers et al. | |
| 2010/0148650 | A1 | 6/2010 | Wu et al. | |
| 2011/0074296 | A1* | 3/2011 | Shen | F21K 9/135 315/112 |

FOREIGN PATENT DOCUMENTS

| | | | |
|---|---|---|---|
| CN | 101649965 | A | 2/2010 |
| DE | 202007008258 | U1 | 10/2007 |
| DE | 102009035370 | A1 | 2/2011 |
| FR | 2941346 | A1 | 7/2010 |
| JP | 11990049008 | U | 4/1990 |
| JP | 8293204 | A | 11/1995 |
| JP | 2011138784 | A | 7/2011 |
| WO | 2009150574 | A1 | 12/2009 |
| WO | 2010031810 | A1 | 3/2010 |
| WO | 2010079436 | A1 | 7/2010 |
| WO | 2010136950 | A1 | 12/2010 |
| WO | 2010136985 | A1 | 12/2010 |
| WO | WO2011012498 | A1 | 2/2011 |

* cited by examiner

ILLUMINATION DEVICE WITH CARRIER AND ENVELOPE

FIELD OF THE INVENTION

The present invention relates to an illumination device and, in particular, to an illumination device suitable for use with a heat-sensitive light source.

BACKGROUND OF THE INVENTION

Light-emitting-diode (LED) lamps are known in the art. A LED lamp is a lamp that uses LEDs as the source of light. In such lamps, multiple diodes may be used, e.g. for increasing the output power of the lamp or for providing a white light. LED lamps may be used for a general lighting or even for a more specific lighting, as the colour and the output power of the LEDs may be tuned.

Generally, a lamp or illumination device comprises a light source arranged to generate light, wherein the light source is mounted on, or at least connected to, a circuit board. The light source may be arranged within an encapsulating housing, usually having the shape of a bulb. In addition to provide a maximum output of light and/or a specific colour of light, the design of an illumination device needs to take into account the evacuation of heat generated by the light source(s) and/or the electronics connected to the light source(s).

In WO 2010/136985, a LED-based illumination device is disclosed comprising a light source, a carrier for supporting the light source, and an envelope. The carrier, shaped as a disc, is arranged within the envelope, wherein the edge(s) of the carrier is in contact with the envelope along an inner circumference of the envelope. By this arrangement, the carrier divides an inner space of the envelope into two parts. For a transfer of heat generated within the LED-based illumination device during operation, the carrier is arranged in thermal contact with the envelope along the entire axial extent of the envelope. This may lead to an uneven brightness distribution over the surface of the envelope.

In view of this, alternative solutions for an illumination device may be of interest.

SUMMARY OF THE INVENTION

It is an object of the present invention to provide an illumination device which achieves heat management during operation while still providing desired optical properties.

This and other objects are achieved by providing a illumination device having the features in the independent claim. Preferred embodiments are defined in the dependent claims.

Hence, according to the present invention, there is provided an illumination device comprising a light source arranged to generate light. The illumination device comprises a thermally conducting carrier arranged to support the light source. Furthermore, the illumination device comprises an envelope, wherein the carrier and the envelope together form a single compartment at least partially enclosing the light source. The carrier is arranged to transfer heat away from the light source to the envelope, and the envelope is arranged to dissipate heat away from the illumination device. Thus, the present invention is based on the idea of providing an illumination device wherein the light source is in thermal contact with the carrier, and the carrier in its turn is in thermal contact with the envelope, wherein the carrier and the envelope form a single compartment. Hence, the carrier and envelope of the illumination device provide an efficient heat transfer and superior optical properties.

The present invention is advantageous in that the envelope (which may be shaped as a bulb) may act as a heat sink. The envelope efficiently transfers heat away from the illumination device, wherein the heat is generated by the light source during operation. Since the function of heat evacuation is fulfilled by the carrier and/or envelope of the illumination device, the present invention is advantageous in that it does not require any additional (or specific) components for heat transfer. Hence, the present invention provides a cheaper, simpler and/or more easily assembled illumination device compared to arrangements in the prior art.

The present invention is further advantageous in that the carrier and the envelope together form a single compartment at least partially enclosing the light source. The single compartment ameliorates the distribution of light within the compartment compared to arrangements in the prior art. For example, arrangements wherein a light bulb is divided into two or more compartments/sections, e.g. by a carrier, may lead to optical obstructions for the light emitted by the light source during operation. As a result, the light emitted into the surrounding environment from such an arrangement may be unsatisfactory in terms of light distribution. More specifically, the light distribution may especially be inadequate in a near field (<1 cm). In contrast, the single compartment, formed together by the carrier and the envelope, of the present invention provides a homogeneous, substantially omnidirectional light distribution of the illumination device.

Moreover, the single compartment of the illumination device avoids occurrences of visible shades on the light bulb, which may be present e.g. in illumination devices comprising multiple-compartment arrangements. Compared to arrangements of this kind, the single compartment (one mixing chamber) formed together by the carrier and the envelope provides a more evenly distributed light from the surface of the illumination device, resulting in an aesthetically more pleasing appearance of the illumination device during operation.

The present invention is further advantageous in that the illumination device comprises a low number of components, thereby providing an easy assembly and/or relatively cheap realization of the illumination device. Moreover, the illumination device of the present invention is suitable both for retrofit and non-retrofit solutions. For example, the illumination device may be readily re-designed for specific purposes, e.g. regarding its optical properties (such as the light distribution) and/or its physical properties (such as size/dimensions of the illumination device).

The carrier of the present invention may further be in thermal contact with a device on which the light source is arranged, e.g. a printed circuit board (PCB). By this measure, the heat transfer from the light source and/or PCB to the carrier may be even further improved. It will be appreciated that the light source does not necessarily have to be in direct physical contact with the carrier for a transfer of heat from the light source to the carrier. Alternatively, the light source may be separated from the carrier, wherein the light source and the carrier still are in thermal contact, e.g. via one or more elements.

According to an embodiment of the present invention, the carrier and the envelope may form a single integrated part. The present embodiment is advantageous in that the carrier and envelope may act as a heat sink in the illumination device. Furthermore, in the present embodiment, the whole surface of the integrated carrier and envelope may act as a heat sink, thereby providing a relatively large surface for a transfer of heat away from the illumination device. Moreover, by the formation of a single integrated part of the carrier and the envelope, an even more improved heat transfer between the carrier and the envelope is achieved, compared to e.g. a carrier and an envelope provided as separate elements. This is realized as the single integrated part circumvents the need for a connection/fastening between the carrier and the envelope, which may otherwise block the heat flow.

This embodiment of the present invention is further advantageous in that the single integrated part of the carrier and the envelope avoids the occurrence of seam(s) between the carrier and/or envelope. Seams on the surface of the illumination device are undesired in that they may cause an inhomogeneous light distribution (e.g. comprising shades) into the surrounding environment of the illumination device during operation. The present embodiment avoids this deteriorating effect on the light distribution, and provides a homogeneous, omnidirectional light distribution in a far and/or close field of the illumination device. Furthermore, seams on the illumination device surface may be considered unaesthetic by a user/observer, independently of the illumination device being in operation ("on" mode) or not ("off" mode). In an "off" mode of the illumination device, a visible (possibly uneven, irregular and/or protruding) seam of an illumination device may be considered unattractive.

The present embodiment of the invention is further advantageous in that the single integrated part of the carrier and the envelope, wherein the single integrated part preferably comprises a material with high light transmission properties, encloses the light source. This is realized as the manufacturing of the illumination device for providing the desired optical properties of the illumination device becomes easier, as only one single integrated part is produced. Furthermore, an illumination device comprising a carrier and an envelope as separate elements may be exposed to assembling defects resulting in a deterioration of the optical properties of the illumination device, e.g. related to a misalignment between the carrier and the envelope. Moreover, an inclusion of connecting means (e.g. glue) between the carrier and the envelope may deteriorate the optical properties, e.g. by an obstructing and/or an undesired refraction of the light. This embodiment of the present invention, wherein the carrier and the envelope together form a single integrated part, mitigates/overcomes problems of this kind and provides an improved light distribution from the illumination device.

By "single integrated part", it is here meant that the carrier and the envelope are of the same material. Further, the carrier and the envelope may be made from a single mould. For example, the carrier and the envelope may be in one piece from a ceramic material. The present embodiment is further advantageous in that the manufacturing of the carrier and envelope as a single integrated part becomes easier and/or cheaper, e.g. compared to an arrangement of separate elements which are to be connected/attached/fastened.

According to an embodiment of the present invention, the light source may be arranged to radiate light into a predefined region of space, the carrier being arranged in relation to the light source such that the carrier is arranged at least partially outside this region of space. The carrier is arranged at least partially outside this region of space such that it avoids an obstruction of the light from the light source. In other words, by this arrangement, the carrier does not block/obstruct the light from the light source. Elements which are arranged for purposes of heat transfer in prior art lighting devices are often provided in front of (in a main direction of the light from) the light source, with the aim of increasing the heat transfer efficiency of the device. However, with this arrangement of the elements, the light from the light source is often obstructed. This may lead to an undesired light distribution of the lighting device, e.g. by a formation of shades. In contrast, the present embodiment of the invention provides an unobstructed lighting from the light source by the arrangement of the carrier at least partially outside this region of space, while still achieving a superior heat management of the illumination device during operation.

According to an embodiment of the present invention, the carrier may be arranged at a base portion of the envelope. By "base portion", it is here meant a proximal/connecting portion of the envelope, e.g. the open portion of the envelope opposite the summit/pole of a bulb portion of the envelope. The arrangement of the carrier at the base portion of the envelope is advantageous in that the carrier even further allows a clear/free/unobstructed flow/radiation of light from the light source.

According to an embodiment of the present invention, the carrier may comprise a through hole arranged to accommodate the light source. In other words, a light source of the illumination device, e.g. a LED, may protrude through the hole of the carrier. The present embodiment is advantageous in that the carrier conveniently supports the light source. Furthermore, since the through hole of the carrier provides a (tight) fit of the carrier to the light source, the heat transfer between the light source and the carrier is improved. Moreover, this embodiment allows that the PCB abuts the carrier, thereby providing an even more efficient heat transfer between the light source and/or the PCB to the carrier.

According to an embodiment of the present invention, the carrier and the envelope comprise ceramic material. The present embodiment is advantageous in that ceramic material has a high thermal conductivity, thereby even further improving the heat transfer from the light source to the carrier, from the carrier to the envelope and/or from the envelope to the surrounding environment of the illumination device.

According to an embodiment of the present invention, the ceramic material may be translucent poly crystalline aluminium oxide (PCA). PCA is advantageous in that it is a translucent ceramic material which has a high thermal conductivity (approximately 20 W/mK). Furthermore, PCA provides the advantage of being electrically insulating and having excellent mechanical properties.

According to an embodiment of the present invention, the envelope may comprise a transmissive region arranged to transmit at least part of the light generated by the light source. The transmissive region may be translucent (providing transmission and scattering of light) or be transparent (providing substantially unhindered transmission). Advantageously, the transmissive region is translucent, thereby preventing a user from perceiving the light source(s) and optional circuitry within the envelope of the illumination device.

According to an embodiment of the present invention, the envelope may comprise a reflective region arranged to reflect at least part of the light generated by the light source. The present embodiment is advantageous in that the envelope may be designed to reflect the light at one or more regions, before the light is transmitted away from the illumination device. By this, a desired light distribution of the illumination device is achieved.

According to an embodiment of the present invention, the illumination device may further comprise a light guide arranged to guide the light from the light source. By "light guide", it is here meant an element having light transmissive properties such that the light may be guided/led/transported from the light source towards/into a desired region of the illumination device. This embodiment of the present invention is advantageous in that the light distribution of the illumination device may be even further improved.

According to an embodiment of the present invention, the light guide may project into the compartment for thereby radiating light generated by the light source from a substantially central region in the compartment. In other words, the light from the light source may be guided within the light guide into the compartment of the illumination device for subsequent transmission of light from the projecting light guide. The present embodiment is advantageous in that the light guide even further ameliorates the light distribution of the illumination device in the surrounding environment during operation. In particular, the light guide improves the omnidirectional light distribution of the illumination device. Furthermore, the present embodiment is advantageous in that the light source may be provided close to the carrier, for the purpose of a transfer of heat away from the light source, whereas the light from the light source provides an improved light distribution by the light guide from the substantially central region of the compartment.

According to an embodiment of the present invention, the light guide may comprise an inner envelope, at least partially enclosing said light source. In other words, the inner envelope may at least partially encompass/cover the light source, wherein the inner envelope may have the form of e.g. a hollow cone, a bulb, a lens, or the like. The present embodiment is advantageous in that the inner envelope may be designed to provide a desired light distribution of the light radiated by the light source into the interior of the illumination device, before being further distributed by the envelope and/or carrier into the surrounding environment of the illumination device. The elongated shape of the inner envelope may result in a different filament effect compared to that having a substantially spherical shape. Independently of (or in combination with) the inner envelope, the lens of the light source (e.g. the LED) may itself be shaped for providing a desired light distribution of the illumination device.

According to an embodiment of the present invention, the inner envelope may be bulb-shaped, flexible, and comprise a phosphor coating. Advantageously, the inner envelope may comprise silicone.

According to an embodiment of the present invention, the light source may comprise at least one light emitting diode (LED). The light source may for instance comprise an RGB LED (red-green-blue LED), or a plurality of diodes arranged to provide white light, such as an RGB combination, or a combination of blue and yellow, or a combination of blue, yellow and red, etc. Optionally, the illumination device may be arranged to provide coloured light. The light source may also comprise a plurality of light sources (such as a plurality of LEDs), that is (are) able to provide light at different predetermined wavelengths, depending upon the driving conditions. Hence, in a specific embodiment, the illumination device may further comprise a controller (attached to or external from the illumination device), arranged to control the colour of the illumination device light in response to a sensor signal or a user input device signal. Furthermore, the light source may comprise one or more high-voltage (HV) LEDs. An arrangement of HV LEDs is advantageous in that the number of components necessary to form the illumination device is further reduced as HV LEDs merely require a simple driver.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1A:
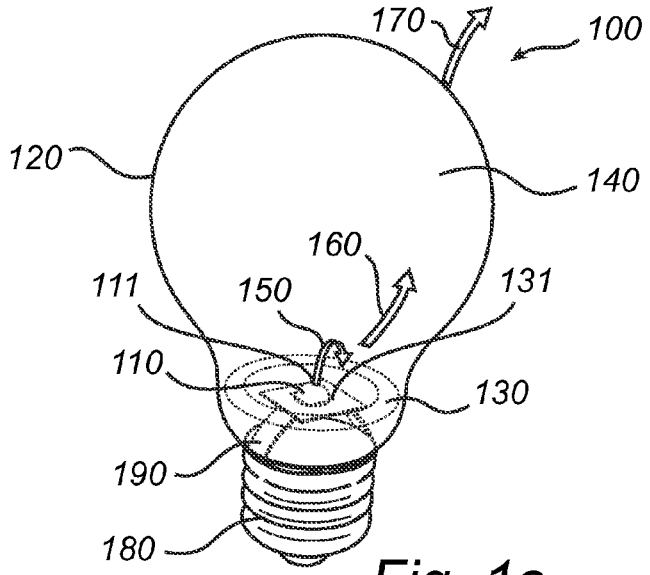
FIG. 1*a-c* is an external view, a cutaway view, and an exploded view, respectively, of an illumination device according to an exemplifying embodiment of the present invention.
Figure 1B:
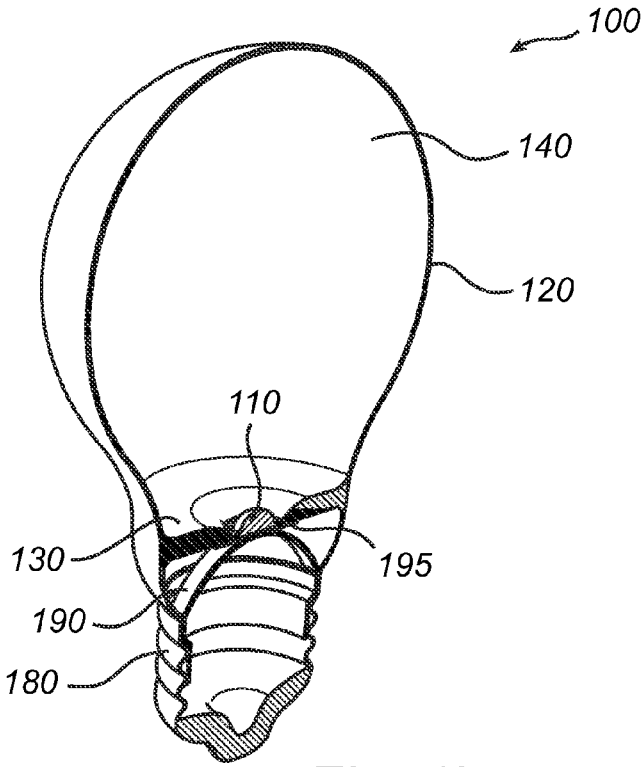
Figure 1C:
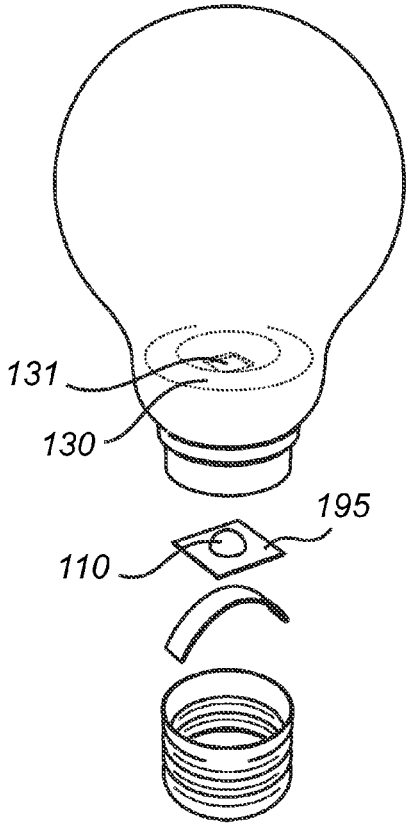

With reference to FIG. 1*a-c*, a first embodiment of the present invention is described.

FIG. 1*a* shows an illumination device 100 according to an embodiment of the present invention. The illumination device 100 comprises a light source 110 arranged to generate light. In the present example, the light source 110 corresponds to a single LED 111 arranged on a printed circuit board (PCB) (not shown in FIG. 1*a*). Although FIG. 1*a* shows a single LED 111 to form the light source 110, a plurality of LEDs or LED packages may also be provided. Furthermore, the light source 110 may comprise one or more high-voltage (HV) LEDs. Even more advantageously, phase-shifted HV LEDs may be provided for preventing stroboscopic effects.

The illumination device 100 further comprises an envelope 120, which in FIG. 1*a* is bulb-shaped. However, virtually any other shape of the envelope 120 may be feasible.

In FIG. 1*a*, the illumination device 100 further comprises a thermally conducting carrier 130 arranged to support the light source 110. The carrier 130 in FIG. 1*a* is formed as a disc at a base portion of the envelope 120, but may in principle have any other form or shape. The carrier 130 comprises a through hole 131 in the center of the carrier 130, accommodating the light source 110. The light source 110 protrudes through the hole 131 of the carrier 130 such that the light source 110 is arranged to radiate light towards the interior of the envelope 120. The light source 110 is arranged on the PCB, whereby the back side of the carrier 130 abuts against the front side of the PCB when the light source 110 is arranged within the through hole 131 of the carrier 130. Furthermore, by this arrangement, electronic components of the PCB are provided below the carrier, and thereby "hidden" for a user.

In FIG. 1*a*, the carrier 130 and the envelope 120 form a single compartment 140 of the illumination device 100, i.e. the carrier 130 and the envelope 120 define an undivided space of the illumination device 100. The single compartment 140 may also be defined as one (single) mixing chamber. In FIG. 1*a*, the light source 110 is at least partially enclosed by the carrier 130 and the envelope 120.

The carrier 130 is arranged in thermal contact with the light source 110. In other words, the carrier 130 is arranged for a transfer of a first heat flow 150 away from the light source 110 to the carrier 130. Furthermore, by the arrangement of the carrier 130 with respect to the PCB, the first heat flow 150 may alternatively (or in addition to the first heat flow 150 between the light source 110 and the carrier 130) comprise a heat transfer between the PCB and the carrier 130.

Furthermore, the carrier 130 is arranged in thermal contact with the envelope 120 such that a second heat flow 160 may be transferred from the carrier 130 to the envelope 120.

The envelope 120, in its turn, is arranged to transfer a third heat flow 170 away from the illumination device 100. Hence, the first heat flow 150 from the light source 110 and/or PCB to the carrier 130 is further transmitted as the second heat flow 160 to the envelope, and eventually transmitted as the third heat flow 170 to the surrounding environment of the illumination device 100. The third heat flow 170 may further comprise heat contributions from the compartment 140 to the envelope 120.

The illumination device 100 in FIG. 1 may also comprise a cap 180 for holding the envelope 120 and for supplying electricity to the light source 110.

In FIG. 1*a*, the illumination device 100 further comprises an element 190, which may be a blade spring, for supporting the PCB. The element 190 is shaped as an elongated strip which forms an arc (semicircle). The element 190 is arranged to support the PCB by clamping/pushing the PCB towards the carrier 130, i.e. to fix the position of the PCB and the LED(s)/electronics arranged thereupon. The convex portion of the element 190 abuts the back side of the PCB, and the two end portions of the element 190 abut an edge portion of the cap 180 such that the element 190, in its turn, is clamped between the cap 180 and the PCB.

In FIG. 1*a*, the carrier 130 and the envelope 120 form a single integrated part. For example, the carrier 130 and the envelope 120 may be made out of a single mould. Alternatively, the carrier 130 may be glued to the inside of the envelope 120. In the case of such a fastening, the glue may advantageously have high thermal conductive properties such that the second heat flow 160 may be effectively transferred from the carrier 130 to the envelope 120.

The carrier 130 and the envelope 120 in FIG. 1*a* may comprise ceramic material. The term "ceramic" is known in the art and may especially refer to an inorganic, non-metallic solid prepared by the action of heat and subsequent cooling. Ceramic materials may have a crystalline or partly crystalline structure, or may be amorphous, i.e., a glass. Most common ceramics are crystalline. The term ceramic especially relates to materials that have sintered together and form pieces (in contrast to powders). The ceramics used herein are preferably polycrystalline ceramics. The ceramic material may for instance be based on one or more materials selected from the group consisting of $Al_2O_3$, AlN, $SiO_2$, $Y_3Al_5O_{12}$ (YAG), an $Y_3Al_5O_{12}$ analogue, $Y_2O_3$ and $TiO_2$, and $ZrO_2$.The term an $Y_3Al_5O_{12}$ analogue refers to garnet systems having substantially the same lattice structure as YAG, but wherein Y and/or Al and/or O, especially Y and/or Al are at least partly replaced by another ion, such as one or more of Sc, La, Lu and G, respectively.

According to an embodiment, the ceramic material may be $Al_2O_3$, which is a translucent material. $Al_2O_3$ can also be made highly reflective when it is sintered at a temperature in the range of about 1300-1700° C., such as in the range of about 1300-1500° C., like 1300-1450° C. This material is also known in the art as "brown" PCA (polycrystalline alumina).

The term "based on" indicates that the starting materials to make the ceramic material substantially consist of one or more of the herein indicated materials, such as for instance $Al_2O_3$ or $Y_3Al_5O_{12}$ (YAG). This does however not exclude the presence of small amounts of (remaining) binder material, or dopants, such as Ti for $Al_2O_3$, or in an embodiment Ce for YAG.

The ceramic material may have a relatively good thermal conductivity. Preferably, the thermal conductivity is at least about 5 W/mK, such as at least about 15 W/mK, even more preferably at least about 100 W/mK. YAG has a thermal conductivity in the range of about 6 W/mK, poly crystalline alumina (PCA) in the range of about 20 W/mK, and AlN (aluminum nitride) in the range of about 150 W/mK or larger.

Advantageously, the ceramic material may be poly crystalline aluminium oxide (PCA).

A single integrated part of the carrier and the envelope may be realized by gluing PCA carrier/envelope parts together before applying a sintering process. By gluing the carrier/envelope parts together, the risk of misalignment of the parts due to the high shrink factor during the sintering process is decreased.

FIG. 1*b* shows a cutaway view of the illumination device 100 of FIG. 1*a*. The cutaway view discloses the PCB 195 on which the light source 110 is arranged. Furthermore, FIG. 1*b* shows the formation of the carrier 130 and the envelope 120, wherein the carrier 130 protrudes substantially perpendicular from a base portion of the envelope 120.

FIG. 1*c* shows an exploded view of an illumination device 100 of FIGS. 1*a-b*. Furthermore, FIG. 1*c* serves as an (schematic) assembly process of the illumination device 100. The PCB 195, upon which the light source 110 is provided, is arranged to abut the carrier 130 such that the light source 110 (LED) protrudes through the hole 131 of the carrier 130. The element 190 is arranged to mechanically clamp/push the PCB 195 towards the carrier 130, wherein the convex portion of the element 190 abuts the back side of the PCB 195. The cap 180, in its turn, provides a mechanical support for the two end portions of the element 190, thereby urging the element 190 against the PCB 195.

Figure 2:
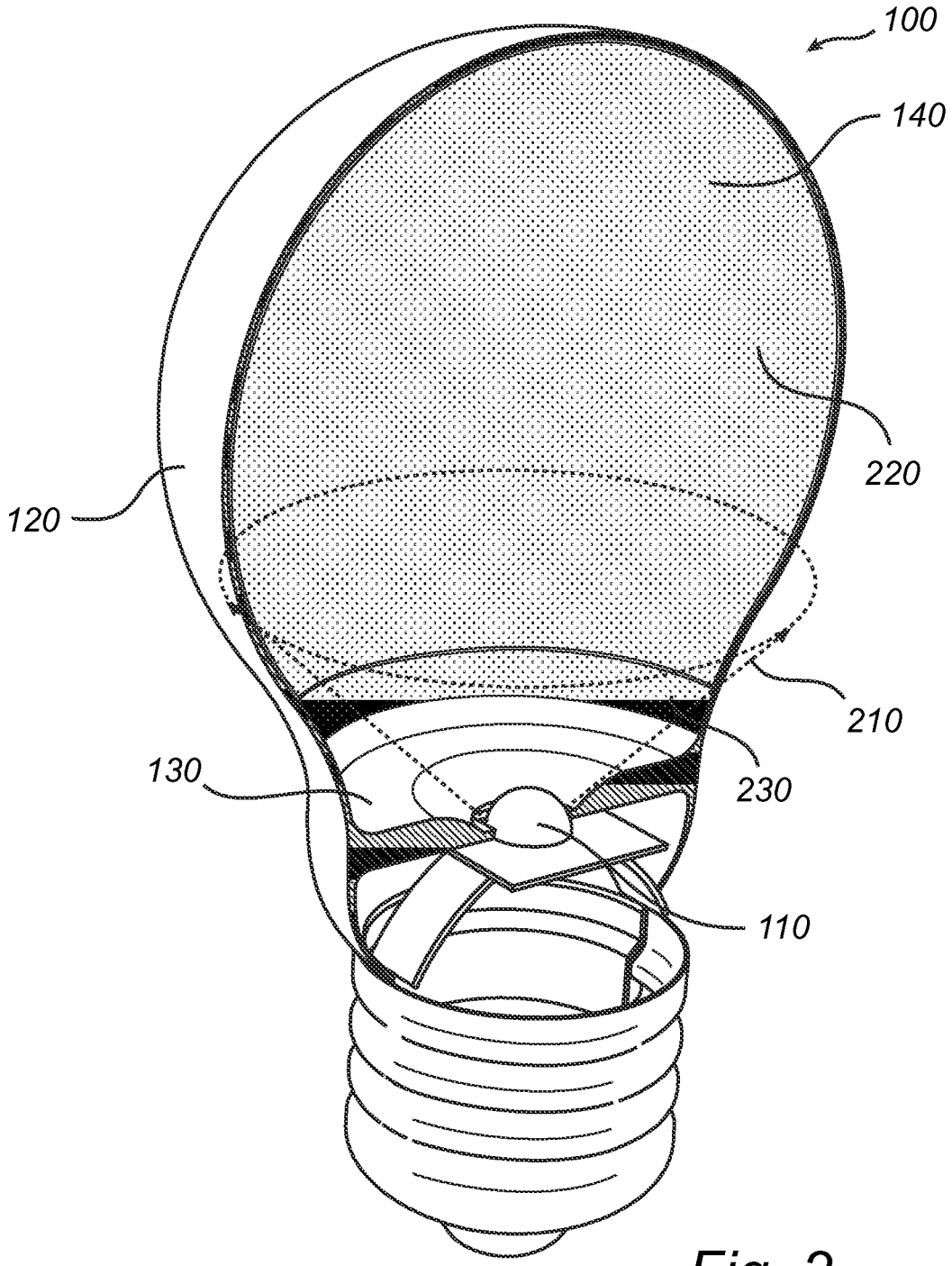
FIG. 2 is an exploded view of an illumination device according to another exemplifying embodiment of the present invention.

FIG. 2 is a view of an illumination device 100 according to FIGS. 1*a-c*. During operation, the light source 110 is arranged to radiate light into a predefined region of space 210. The region of space 210 is by and large defined by the compartment 140 which is formed by the carrier 130 and the envelope 120. The carrier 130 is arranged in relation to the light source 110 such that the carrier 130 is provided at least partially outside the region of space 210. By this, the carrier 130 does not obstruct the light from the light source 110.

The envelope 120 comprises a transmissive region 220 arranged to transmit at least part of the light generated by the light source 110. The transmissive region 220 in FIG. 2 constitutes a major portion of the envelope 120. The transmissive region 220 may be made of a material having light transmissive properties such that an efficient transmission of light through the envelope 120 is achieved. Furthermore, the envelope 120 may comprise a reflective region 230 arranged to reflect at least part of the light generated by the light source 110. In FIG. 2, the reflective region 230 constitutes a relatively small portion at a base portion of the envelope 120. It will be appreciated that the envelope 120 may be designed with a number of regions being either transmissive or reflective such that a desired light distribution is achieved.

Figure 3:
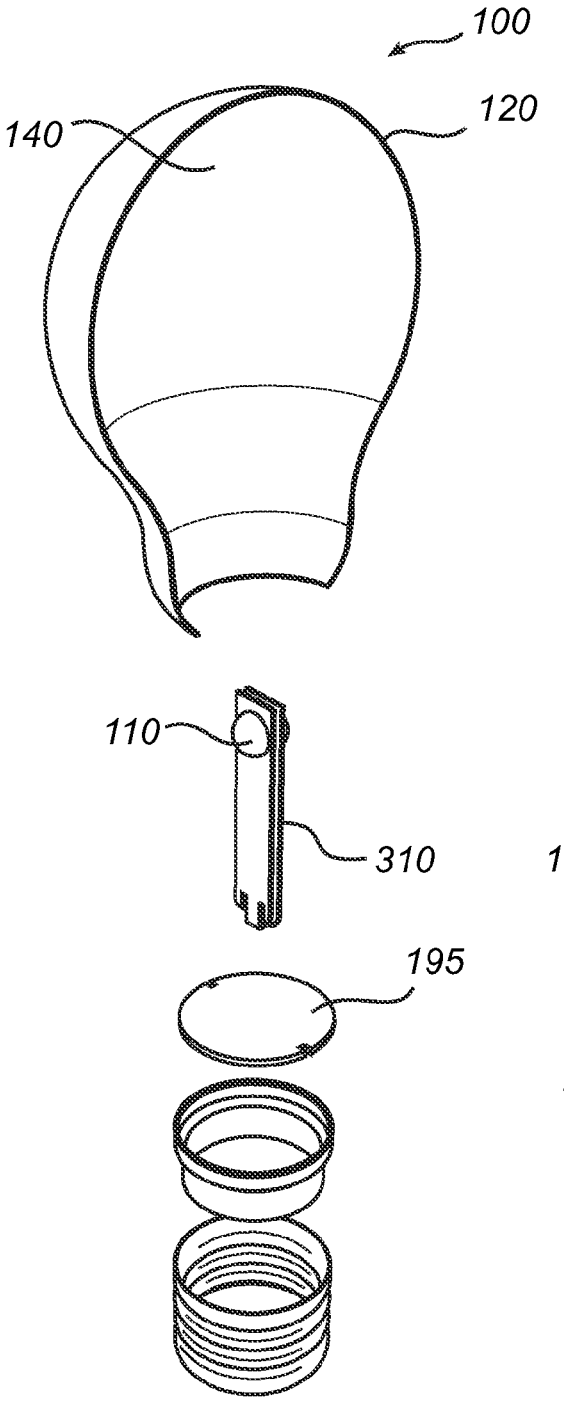
FIG. 3 is an exploded view of an illumination device according to another exemplifying embodiment of the present invention.

FIG. 3 is an exploded view of an illumination device 100. The light source 110 is arranged on a mounting element 310 which protrudes into the compartment 140 of the illumination device 100, the light source 110 thereby being positioned approximately in the middle of the compartment 140. The mounting element 310 is realized as a rectangular-shaped strip, but may have substantially any other shape. For example, the mounting element 310 may be a rod, upon which the light source 110 is arranged. The mounting element 310 is thermally connected, via the carrier (not shown), to the envelope 120 so that the light source 110 is effectively in good thermal contact with the envelope 120 and can dissipate heat to this during operation. In other words, even though the light source 110 is not in direct physical contact with the carrier, the light source 110 and the carrier are still in thermal contact via the mounting element 310. It will be appreciated that the carrier may be realized as any thermally conducting carrier which is arranged to support the light source The PCB 195, from which the mounting element 310 projects, is shaped as a circular disc. In this embodiment of the present invention, a relatively large PCB 195 may be used. The size of the opening of the envelope 120 may be increased to accommodate a relatively large PCB 195.

Figure 4:
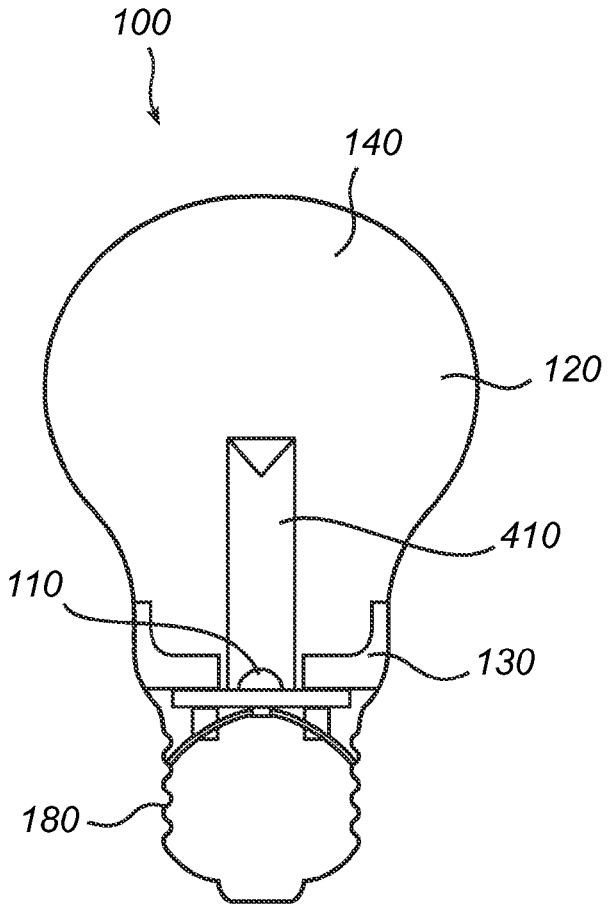
FIGS. 4-5 are schematic cross-sectional views of an illumination device according to other exemplifying embodiments of the present invention.

FIG. 4 is a cross-sectional view of an illumination device 100. A light guide 410 is arranged to guide the light from the light source 110, wherein the light guide 410 projects into the compartment 140. The light guide 410 extends from the light source 110 to a substantially central region of the envelope 120. During operation, the light guide 410 radiates the light generated by the light source 110 from an substantially central region of the compartment 140, and provides for an omnidirectional light distribution from the illumination device 100.

Figure 5:
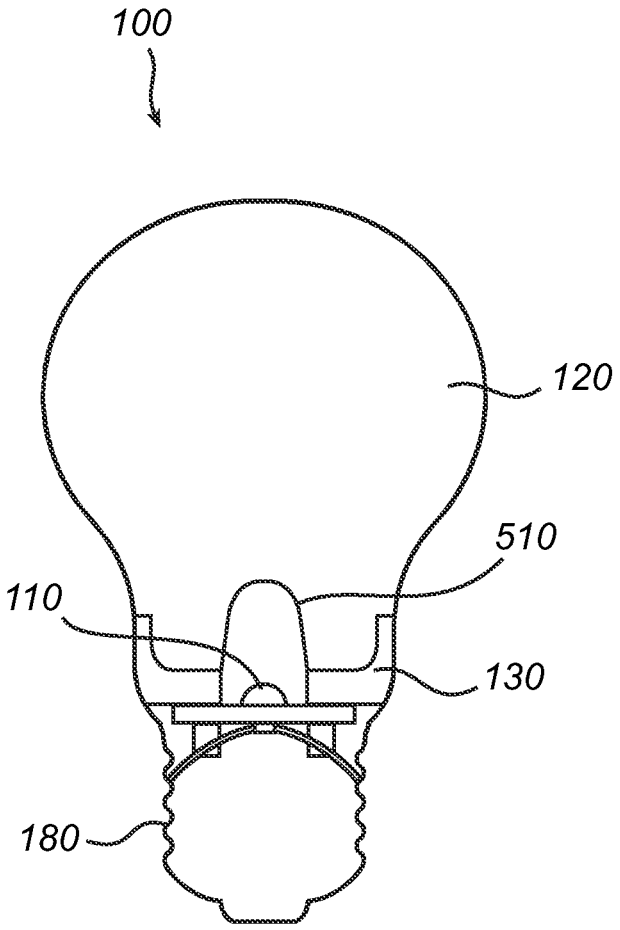

FIG. 5 is a cross-sectional view of an illumination device 100, wherein a light guide is provided in the shape of an inner envelope 510, shaped as an inner bulb, covers the top portion of the light source 110. The inner envelope 510 may for example be a flexible silicone bulb which is coated with phosphor. The inner envelope 510 extends from the light source 110 to approximately ⅓ of the substantially central region of the envelope 120.

The present invention may be useful for any kind of lamp, e.g. a spot light or a standard lamp. The present invention may be applied for illumination arrangements used in substantially any kind of environment, e.g. homes, offices, stores, industry buildings, hospitals. The present invention may also be used in outdoor settings.

The person skilled in the art realizes that the present invention by no means is limited to the preferred embodiments described above. On the contrary, many modifications and variations are possible within the scope of the appended claims. For example, the illumination device 100 itself and/or the individual parts of the illumination device 100 may have different dimensions and/or sizes than those depicted/described. For example, the carrier 130 and the envelope 120 of the illumination device may form a compartment 140 having a standard bulb shape, or, substantially, any other shape, e.g. round, elongated or flat. Moreover, the number of parts, e.g. the number of light sources 110 (LEDs), may be different from that of depicted/described devices.

The invention claimed is:

1. An illumination device comprising:

a light source arranged to generate light, a thermally conducting carrier of non-uniform thickness and arranged to support said light source, an envelope, wherein said carrier and said envelope form a single continuous and integrated part formed from a single mold and together form a single compartment at least partially enclosing said light source, said carrier being arranged to transfer heat away from said light source to said envelope and said envelope being arranged to dissipate heat away from said illumination device.

2. The illumination device according to claim 1, wherein said envelope is substantially spherical in shape.

3. The illumination device according to claim 1, wherein said light source is arranged to radiate light into a predefined region of space, said carrier being arranged in relation to said light source such that said carrier is arranged at least partially outside said region of space.

4. The illumination device according to claim 1, wherein said carrier is arranged at a base portion of said envelope.

5. The illumination device according to claim 1, wherein said carrier defines a through hole arranged to accommodate said light source.

6. The illumination device according to claim 1, wherein said carrier and said envelope comprise ceramic material.

7. The illumination device according to claim 6, wherein said ceramic material is translucent poly crystalline aluminum oxide.

8. The illumination device according to claim 1, wherein said envelope comprises a transmissive region arranged to transmit at least part of the light generated by said light source.

9. The illumination device according to claim 1, wherein said envelope comprises a reflective region arranged to reflect at least part of the light generated by said light source.

10. The illumination device according to claim 1, wherein said envelope is substantially spherical in shape.

11. The illumination device according to claim 1, further comprising a light guide arranged to guide the light from said light source.

12. The illumination device according to claim 11, wherein said light guide projects into said compartment for thereby radiating light generated by said light source from a substantially central region in said compartment.

13. The illumination device according to claim 11, wherein said light guide comprises an inner envelope, at least partially enclosing said light source.

14. The illumination device according to claim 13, wherein said inner envelope is bulb-shaped, flexible, and comprises a phosphor coating.

15. The illumination device according to claim 1, wherein said light source comprises at least one light emitting diode.

16. The illumination device according to claim 1, wherein said envelope comprises a reflective region arranged to reflect at least part of the light generated by said light source.

17. An illumination device comprising:

a light source arranged to generate light, a thermally conducting carrier arranged to support said light source, an envelope, wherein said carrier and said envelope form a single integrated part and together form a single compartment at least partially enclosing said light source, said carrier being arranged to transfer heat away from said light source to said envelope and said envelope being arranged to dissipate heat away from said illumination device, and a biasing member positioned between a cap and the light source, said biasing member is configured to support the light source in a position with respect to said carrier.

18. The illumination device according to claim 17, wherein said envelope comprises a transmissive region arranged to transmit at least part of the light generated by said light source.

19. The illumination device according to claim 17, wherein said carrier defines a through hole arranged to accommodate said light source.

* * * * *